US011241098B2

(12) United States Patent
Waller et al.

(10) Patent No.: US 11,241,098 B2
(45) Date of Patent: Feb. 8, 2022

(54) CASINO CHAIR WITH SLIDING BASE

(71) Applicant: Gary Platt Manufacturing, LLC, Reno, NV (US)

(72) Inventors: Daniel J. Waller, Reno, NV (US); Wendell R. Davis, Reno, NV (US)

(73) Assignee: Gary Platt Manufacturing, LLC, Reno, NV (US)

( * ) Notice: Subject to any disclaimer, the term of this patent is extended or adjusted under 35 U.S.C. 154(b) by 35 days.

(21) Appl. No.: 16/913,072

(22) Filed: Jun. 26, 2020

(65) Prior Publication Data

US 2020/0323347 A1 Oct. 15, 2020

Related U.S. Application Data

(63) Continuation of application No. 16/149,965, filed on Oct. 2, 2018, now Pat. No. 10,694,852.

(60) Provisional application No. 62/567,073, filed on Oct. 2, 2017.

(51) Int. Cl.

| | |
|---|---|
| ***A47C 7/00*** | (2006.01) |
| ***A63G 31/02*** | (2006.01) |
| ***A47C 1/00*** | (2006.01) |
| ***A47C 1/023*** | (2006.01) |

(52) U.S. Cl.

CPC ..... *A47C 7/004* (2013.01); *A47C 1/00* (2013.01); *A47C 1/023* (2013.01); *A63G 31/02* (2013.01)

(58) Field of Classification Search

None

See application file for complete search history.

(56) References Cited

U.S. PATENT DOCUMENTS

| | | | | |
|---|---|---|---|---|
| 3,933,331 | A * | 1/1976 | Blom | B60N 2/0825 248/425 |
| 4,289,351 | A * | 9/1981 | Wahls | B60N 2/0715 248/429 |
| 4,530,540 | A | 7/1985 | Hayden et al. | |
| 5,280,987 | A * | 1/1994 | Miller | B60N 2/01583 248/429 |

(Continued)

FOREIGN PATENT DOCUMENTS

| | | |
|---|---|---|
| DE | 102017104498 | 9/2018 |
| WO | 2018158174 | 9/2018 |
| WO | WO-2020042748 A1 * | 3/2020 |

OTHER PUBLICATIONS

United States Patent and Trademark Office, "Notice of Allowance," issued in connection with U.S. Appl. No. 16/149,965, dated Feb. 21, 2020, 44 pages.

(Continued)

*Primary Examiner* — David E Allred

(74) *Attorney, Agent, or Firm* — Hanley, Flight and Zimmerman, LLC

(57) ABSTRACT

A movable seat such as for use with a gaming device is disclosed and described herein. An example chair includes a chair head assembly and a floorplate assembly. The example chair head assembly is movably affixed to a slide plate in the floorplate assembly to slide the chair head assembly along at least a portion of the floorplate assembly. An example floorplate assembly includes a slide plate and a floorplate. The example slide plate is arranged to receive a support member, and the example slide plate is movably affixed to the floorplate via a track opening along the floorplate.

3 Claims, 9 Drawing Sheets

(56) References Cited

U.S. PATENT DOCUMENTS

| | | | | |
|---|---|---|---|---|
| 6,422,526 | B1 | 7/2002 | Ishikawa et al. | |
| 7,832,799 | B2 | 11/2010 | Davis, Jr. et al. | |
| 7,922,134 | B2 | 4/2011 | Gasser | |
| D654,728 | S | 2/2012 | Gasser | |
| 2007/0228784 | A1 | 10/2007 | Wells, Jr. | |
| 2007/0296255 | A1* | 12/2007 | Cadwallader | A63G 15/04 297/270.5 |
| 2009/0152922 | A1 | 6/2009 | Gasser | |
| 2012/0104218 | A1 | 5/2012 | Nonomiya | |
| 2015/0034791 | A1 | 2/2015 | Kamada et al. | |
| 2015/0150376 | A1 | 6/2015 | Hogue | |
| 2015/0251047 | A1 | 9/2015 | Maaniitty et al. | |
| 2017/0341532 | A1 | 11/2017 | Sowinski et al. | |
| 2018/0022237 | A1 | 1/2018 | Nomura et al. | |
| 2019/0099000 | A1 | 4/2019 | Waller et al. | |
| 2019/0126785 | A1 | 5/2019 | Sasaki et al. | |
| 2021/0206303 | A1* | 7/2021 | Petit | B60N 2/067 |

OTHER PUBLICATIONS

United States Patent and Trademark Office, "Requirement for Restriction," issued in connection with U.S. Appl. No. 16/149,965, dated Oct. 30, 2019, 7 pages.

* cited by examiner

CASINO CHAIR WITH SLIDING BASE

CROSS-REFERENCE TO RELATED APPLICATIONS

This patent claims the benefit as a continuation of U.S. patent application Ser. No. 16/149,965, now U.S. Pat. No. 10,694,852, entitled "Casino Chair With Sliding Base," filed on Oct. 2, 2018, which claims prior to U.S. Provisional Application Ser. No. 62/567,073, entitled "Casino Chair With Sliding Base," filed on Oct. 2, 2017. U.S. patent application Ser. No. 16/149,965 is hereby incorporated herein by reference in its entirety for all purposes. U.S. Provisional Application Ser. No. 62/567,073 is hereby incorporated herein by reference in its entirety for all purposes.

FIELD OF THE DISCLOSURE

This disclosure relates generally to casino chairs, and, more particularly, to casino chairs and associated slider floorplate assemblies.

BACKGROUND

Casino operators often desire chairs for gaming machines, such as, for example, slot machines, to be attached to the machine or to a location adjacent to the machine. This promotes a more orderly and safer casino by preventing inappropriate use or movement of casino chairs. Many jurisdictions require casino operators to use fixed or attached chairs. At the same time, casino chairs are often expected to be movable and/or otherwise adjustable with respect to a gaming machine to accommodate a variety of players and/or a variety of gaming machine configurations. However, stability, protection of cables and underlying electronics, and ease of movement/configurability can be a significant problem with movable chair design.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
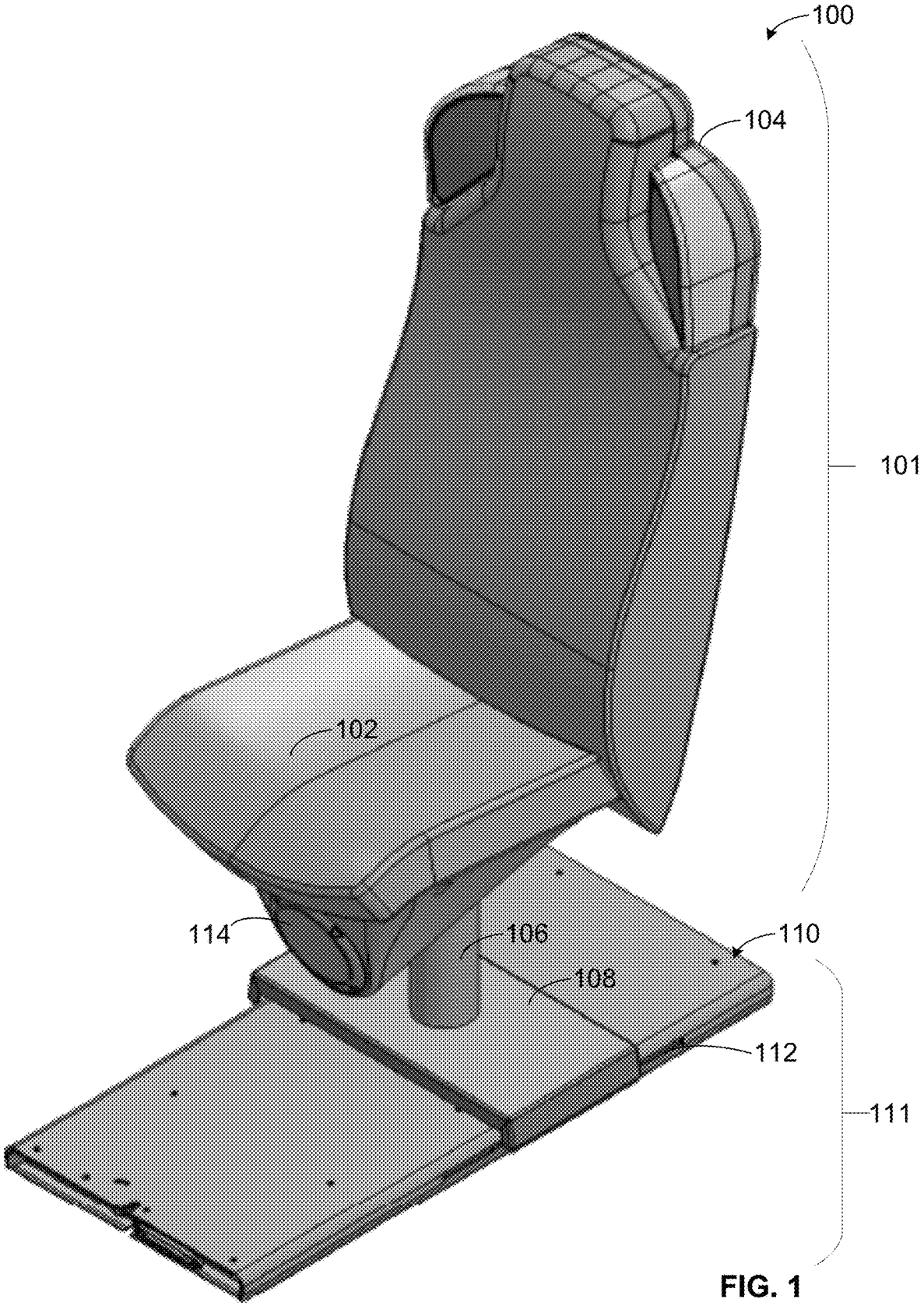
FIG. 1 illustrates a perspective view of an example chair.

In the following detailed description, reference is made to the accompanying drawings that form a part hereof, and in which is shown by way of illustration specific examples that may be practiced. These examples are described in sufficient detail to enable one skilled in the art to practice the subject matter, and it is to be understood that other examples may be utilized and that logical, mechanical, electrical and other changes may be made without departing from the scope of the subject matter of this disclosure. The following detailed description is, therefore, provided to describe an example implementation and not to be taken as limiting on the scope of the subject matter described in this disclosure. Certain features from different aspects of the following description may be combined to form yet new aspects of the subject matter discussed below.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

Certain examples provide a casino or gaming chair, stool, and/or other seat (hereinafter referred to as a "chair") that can be movably positioned with respect to another device such as a gaming machine (e.g., a slot machine, video poker machine, other electronic gaming machine (EGM), etc.), gaming table (e.g., poker table, roulette table, craps table, etc.), bar, counter, etc. The chair allows a user to position themselves with respect to the other device to interact with the other device. In certain examples, the chair can be slidable and/or otherwise positionable with respect to the slot machine, EGM, or other device. For example, the chair can be slidable and/or otherwise positionable along its base to adjust to be closer to or farther from the other device. In certain examples, the base can hook into, be inserted into, snap against, and/or otherwise be positioned in and/or abut the other device. In certain examples, wires and/or other connections can extend from the other device to the chair and be covered and/or otherwise camouflaged by the base of the chair.

The chair includes a chair seat portion, a chair back portion attached to an end of the chair seat portion, and a pedestal, column, or other support member attached at a first end to an underside of the chair seat portion. The pedestal/column can be attached at a second end to a base, slide plate, or column mount. The base/slide plate can be slidable with respect to a footboard or floorplate, which rests on the floor, ground, etc.

In certain examples, the chair is foam-filled (e.g., cold-cured foam blend, other high density molded foam, etc.) for user comfort (e.g., the seat base and/or seat back of the chair can be filled with foam, etc.). In certain examples, the foam is injection molded with built-in lumbar support and other contours to fit the human form. In certain examples, the seat or chair base has a waterfall front edge to relieve stress on a user's legs. In certain examples, the wood is contoured to match the foam to help ensure that neither the wood nor the foam will break down over time. In certain examples, the chair frame incorporates a slider glides that makes the chair easy to move and more user-friendly. In certain examples, a frame of the chair is built with an all-welded construction and designed to stand up to the heavy demands of 24/7 casino use. In certain examples, a base of the chair is an aluminum and/or other metal base.

FIG. 1 illustrates a perspective view of an example chair 100 including a chair head assembly 101 and a floorplate assembly 111. The chair head assembly 101 includes a chair seat portion 102, a chair back portion 104, and a support member 106. The floorplate assembly 111 includes a base or slide plate 108, and a floorplate 110. As shown in the example of FIG. 1, the chair back portion 104 is attached to an end of the chair seat portion 102, and the support member 106 is attached at a first end to an underside of the chair seat portion 102. The support member 106 is attached at a second end to the slide plate 108, which is movably connected to the floorplate 110 along a track, slot, or groove 112. Thus, a user can sit on the chair seat portion 102 and move the seat and back portions 102, 104 via the support member 106 and slide plate 108 with respect to the floorplate 110. While the support member 106 is shown in the example of FIG. 1 as a cylindrical support member or pedestal/column, the support member can be rectangular, elliptical, and/or other shape to connect the chair set portion 102 to the slide plate 108.

As shown in the example of FIG. 1, the slide plate 108 is wider than the floorplate 110. In certain examples, the slide plate 108 is 9 inches deep, and the depth of the chair seat portion 102 is 18-19 inches. In certain examples, the seat 102 width is also 18-19 inches. In certain examples, the chair back portion 104 extends 18-19 inches above a plane defined by the top of the seat portion 102.

A sliding chair base, such as the floorplate assembly 111, can connect the chair 100 to a slot machine, electronic gaming machine, and/or other gaming device, for example. In other examples, the floorplate assembly 111 is not connected to the other device but is positioned in front of and/or otherwise adjacent to (e.g., abutting, etc.) the other device so that a user can sit in the chair 100 and interact with the gaming machine and/or other device.

In certain examples, the chair 100 can include a speaker, subwoofer, and/or other motion generator 114. The speaker 114 can generate sound effects to accompany a game being played via a gaming device positioned adjacent to the chair, for example. As a subwoofer or motion generator, the device 114 can cause the chair seat portion 102 and/or the seat back portion 104 to move, shake, vibrate, etc., for example.

Figure 2:
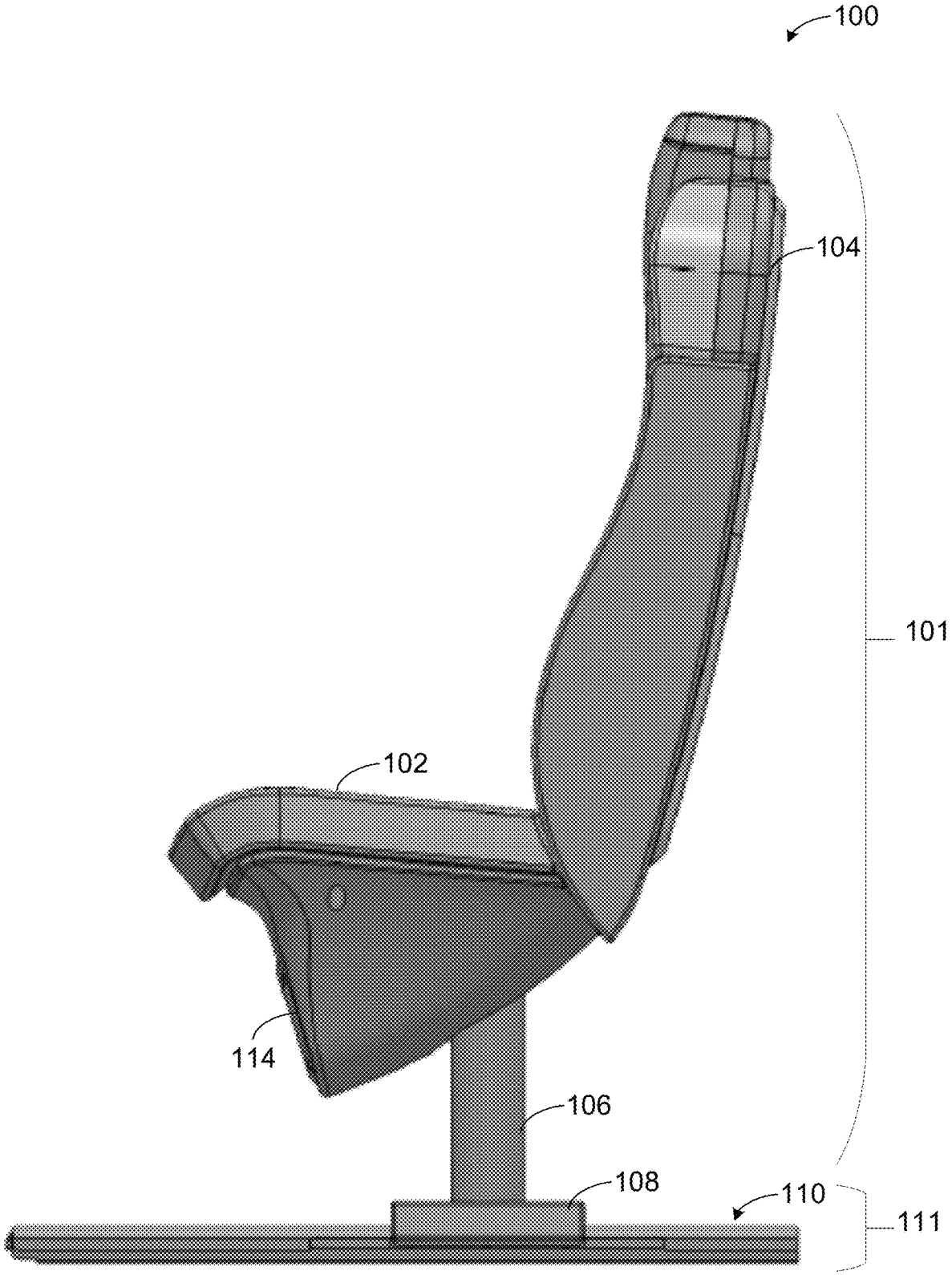
FIG. 2 illustrates a side view of the example chair of FIG. 1.

FIG. 2 illustrates a side view of the example chair 100 of FIG. 1. The example view of FIG. 2 provides another illustration of the relationship between the chair seat portion 102, chair back portion 104, support member 106, slide plate 108, and floorplate 110 of the chair 100. As shown in the example of FIG. 2, the chair seat portion 102/back portion 104 can be slid and/or otherwise laterally moved on/via the support member 106 and slide plate 108 along all or a portion of the floorplate 110 of the floorplate assembly 111. For example, the floorplate 110 can have groove, stopper, guide, etc., limiting the slide plate 108 from traversing an entire length of the floorplate 110, for example. In certain examples, one or more of the chair seat portion 102, chair back portion 104, support member 106, and slide plate 108 can be formed as a single piece and/or integrated structure attached to other components and positioned with respect to the floorplate 110. In certain examples, the chair back portion 104 can tilt or recline with respect to the chair seat portion 102, for example. In certain examples, the chair seat portion 102 can be raised or lowered along the support member 106 to adjust a height of the chair set portion 102/chair back portion 104 for a user.

Figure 3:
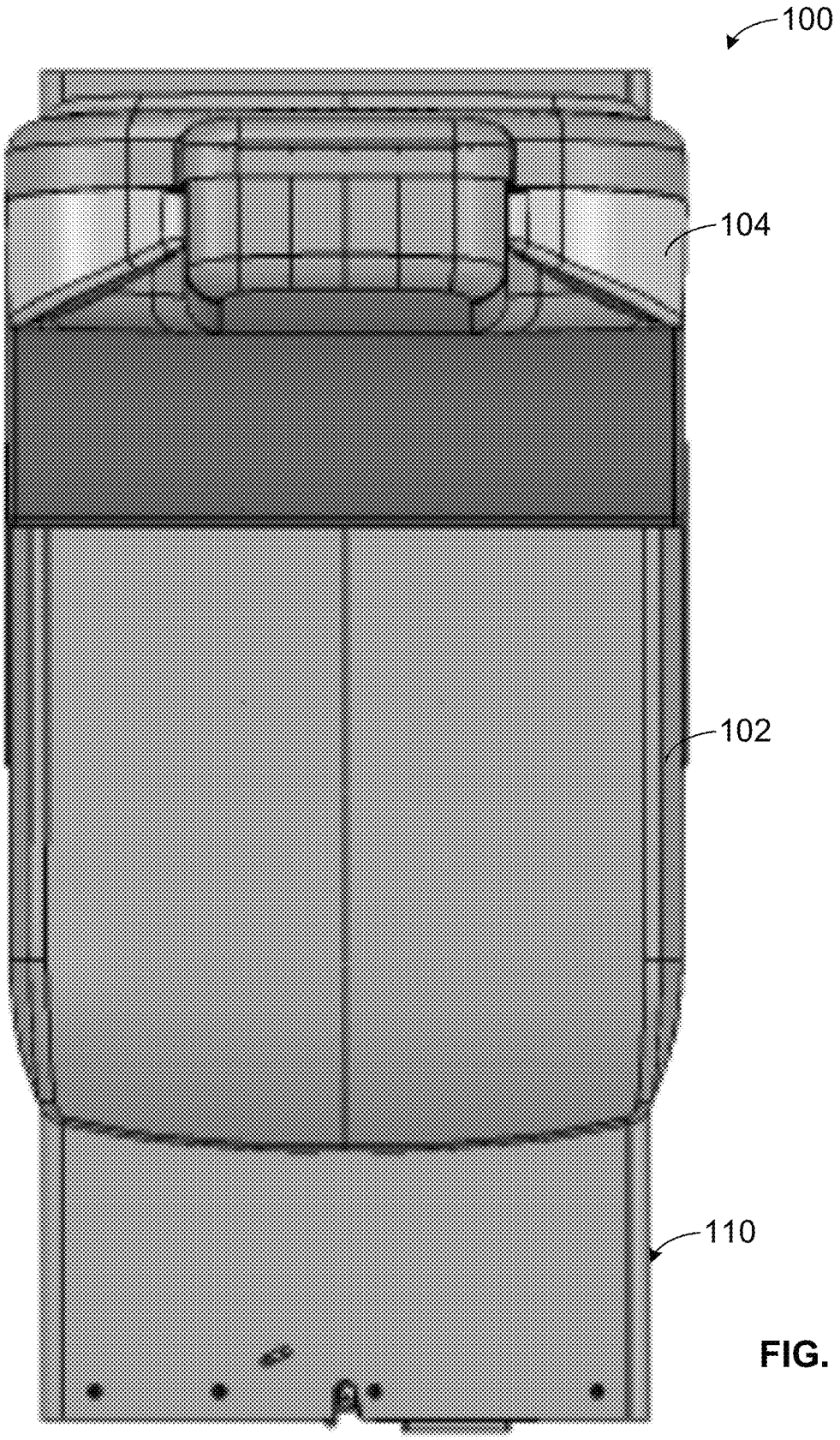
FIG. 3 illustrates a top view of the example chair of FIG. 1.

FIG. 3 illustrates a top view of the example chair 100 of FIG. 1. The example view of FIG. 3 provides another illustration of the relationship between the chair seat portion 102, chair back portion 104, and floorplate 110 of the chair 100. The movement of the support member 106 (not shown in the view of FIG. 3) and the slide plate 108 (also not shown in the view of FIG. 3) allows the chair seat portion 102 and chair back portion 104 to move along the floorplate 110 in the same horizontal plane following the floorplate 110.

Figure 4:
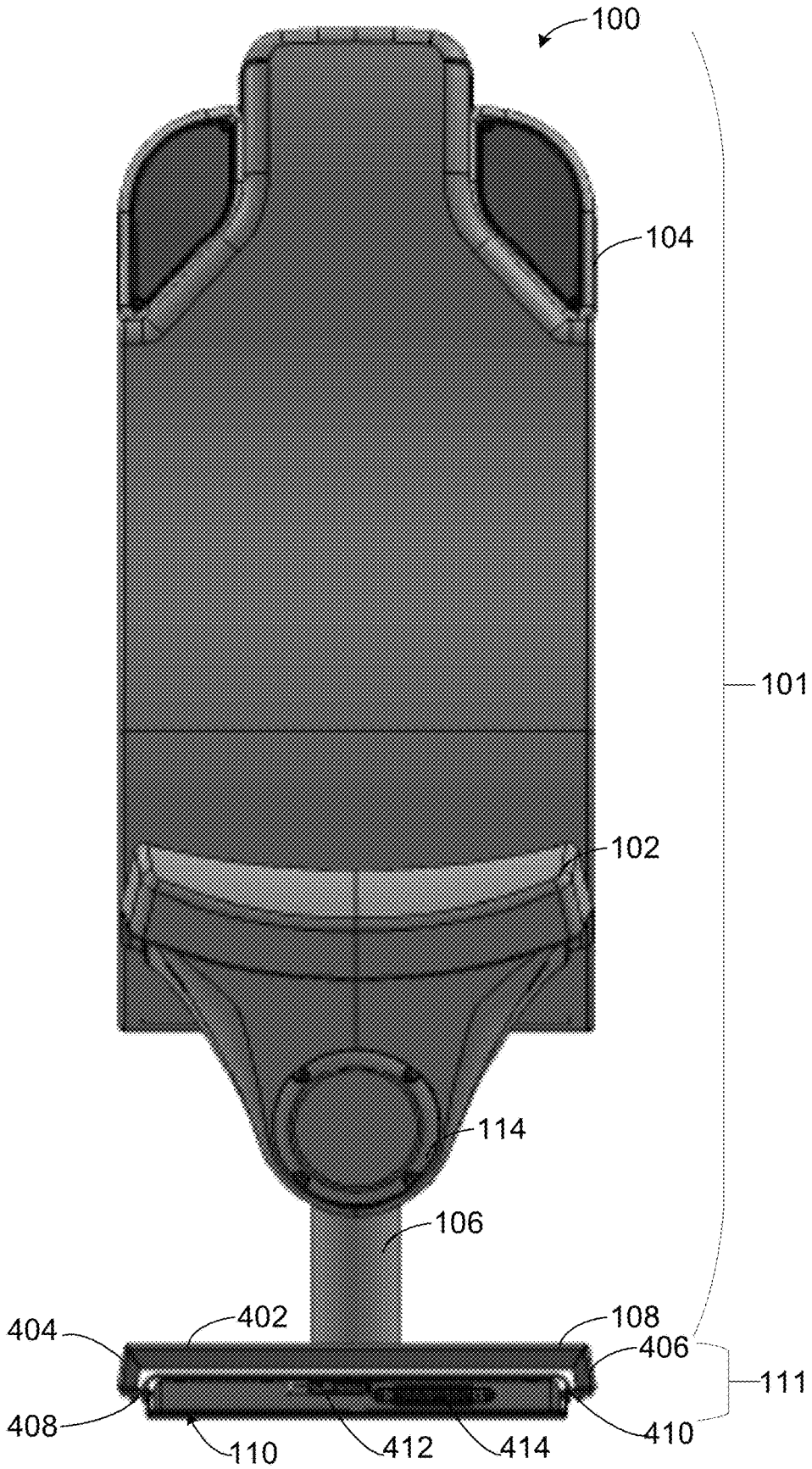
FIG. 4 illustrates a front view of the example chair of FIG. 1.

FIG. 4 illustrates a front view of the example chair 100 of FIG. 1. The example view of FIG. 4 provides another illustration of the relationship between the chair seat portion 102, chair back portion 104, support member 106, slide plate 108, and floorplate 110 of the chair 100. As illustrated in the example of FIG. 4, the slide plate 108 is wider than and fits around the floorplate 110.

In certain examples, such as shown in FIG. 4, the slide plate 108 includes a main body 402 in a plane parallel to the floorplate 110 with two side portions 404, 406 of the slide plate 108 extending down from and perpendicular to the main body. At or near the ends of each side portion, a protrusion 408, 410 (e.g., one or more pins, wings, and/or other extensions) extends from each of the side portions back to the floorplate 110 and is inserted and/or otherwise rests into grooves, slots, and/or other guides in the floorplate 110 such that the protrusions 408, 410 of the side portions 404, 406 keep the slide plate 108 steady and constrained with respect to the floorplate 110. Thus, the protrusions 408, 410 of the side portions 404, 406 of the slide plate 108 allow the slide plate 108 (and attached column 106 and seat 102, 104) to slide, glide, and/or otherwise move along a length of the floorplate 110 within the guide of the floorplate 110 without falling off the floorplate 110, for example.

Further, as shown in the example of FIG. 4, the floorplate 110 can include one or more connectors 412, 414 to secure the chair 100 to a gaming machine, bar, and/or other device, connecting gaming machine electronics to mechanisms of the chair 100 (e.g., speaker 114, other motion control, game control, etc.), etc. Thus, input from the chair 100 can be conveyed to the connected device and/or vice versa, and/or the chair 100 can be secured to the device, bar, etc., to help avoid toppling of the chair 100 and/or other undesirable movement outside the range of the floorplate 110, for example.

Figure 5:
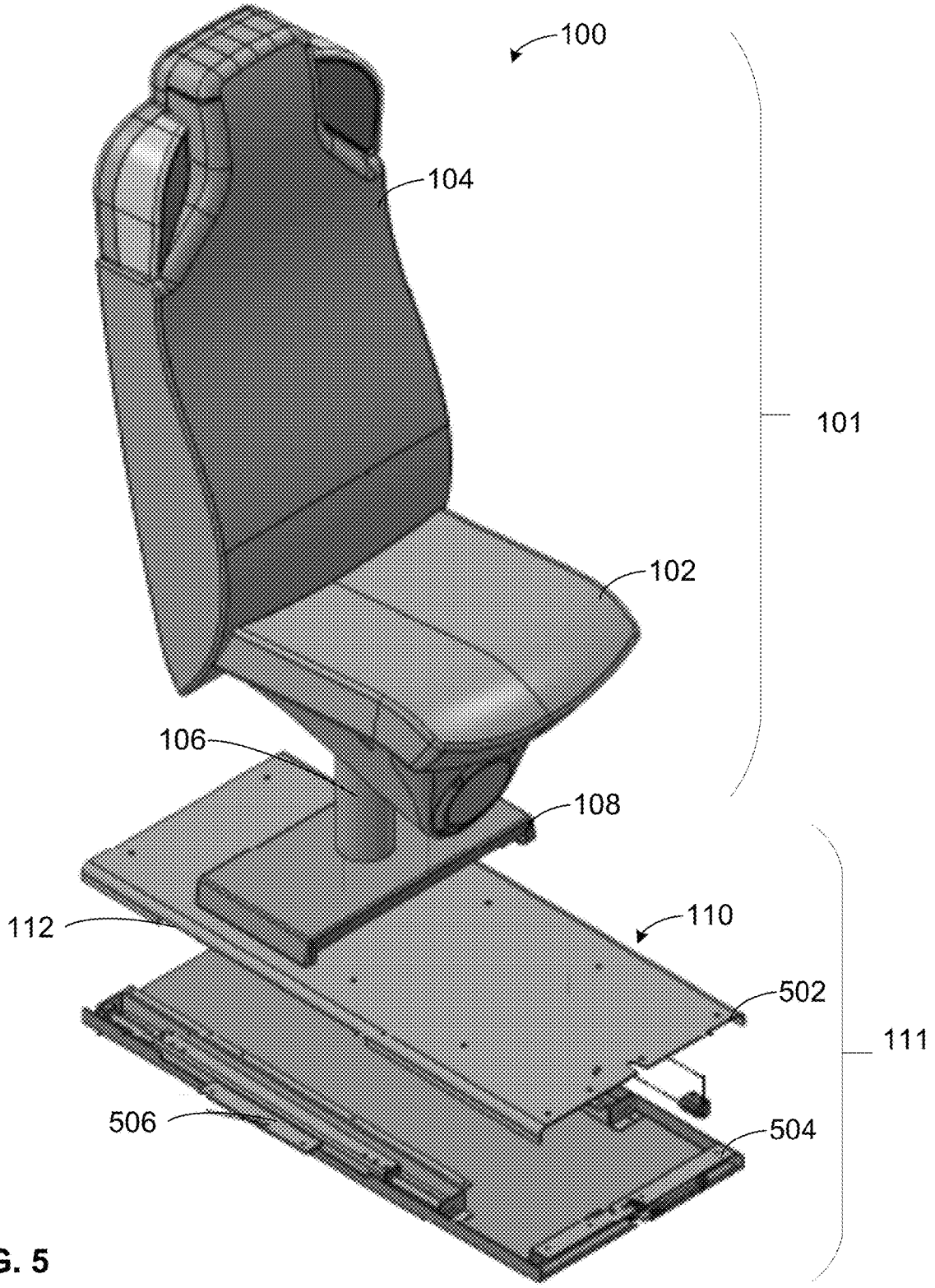
FIG. 5 provides an exploded perspective view of the example chair of FIG. 1.

FIG. 5 provides a perspective view of the example chair 100 of FIG. 1 with an exploded view of the floorplate assembly 111. The example view of FIG. 5 provides another illustration of the relationship between the chair seat portion 102, chair back portion 104, support member 106, slide plate 108, and floorplate assembly 111 of the chair 100. As shown in the exploded view of the example of FIG. 5, the floorplate assembly 111 includes an upper plate 502, a lower plate 504, and a slide plate mount 506, which together form the floorplate 110. The upper plate 502 is affixed to the lower plate 504 forming an opening, groove, or track 112 into which the protrusions 408, 410 of the slide plate 108 can be placed and supported by the slide plate mount 506 to move along the opening 12 of the floorplate 510. In certain examples, the slide plate mount 506 is rigid to passively support the slide plate 108 protrusions 408, 410. In other examples, the slide plate mount 506 moves, and the protrusions 408, 410 attach to the slide plate mount 506 to move along the opening 12 of the floorplate 110.

Figure 6:
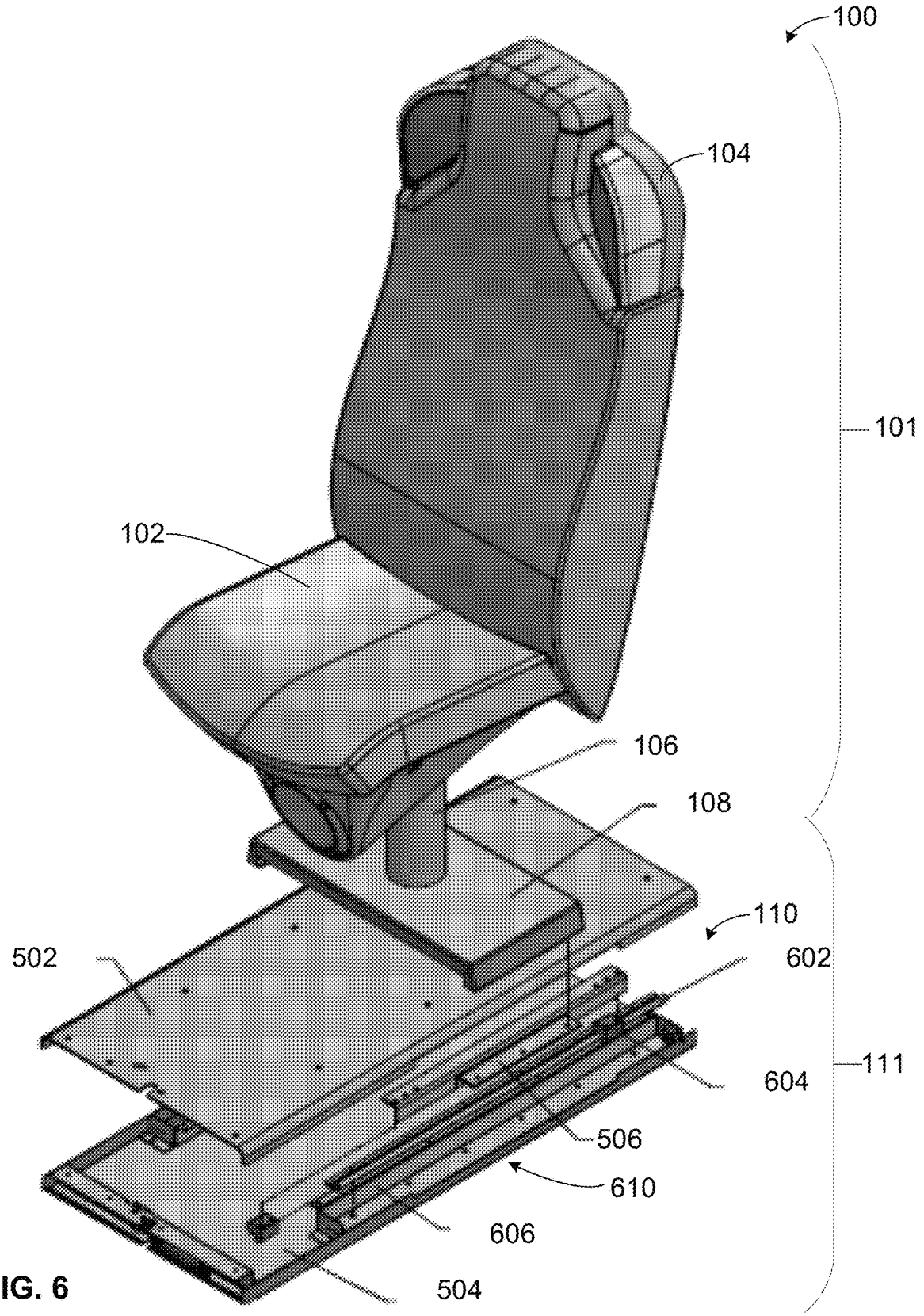
FIG. 6 provides another exploded perspective view of the example chair of FIG. 1.

FIG. 6 provides another exploded perspective view of the example chair 100 with floorplate assembly 111 of FIG. 1. The example view of FIG. 6 provides another illustration of the relationship between the chair seat portion 102, chair back portion 104, support member 106, slide plate 108, and floorplate assembly 111 of the chair 100. As shown in the exploded view of the example of FIG. 5, the floorplate assembly 111 includes an upper plate or floorplate cover 502, a lower plate or floorplate 504, and a slide plate mount 506, as well as a guide rail 602, a hybrid bearing 604, and a guide rail support 606, which together form the floorplate 110.

As shown in the example of FIG. 6, the guide rail 602 mounts to the slide plate mount 506, and the slide plate mount 506 attaches to the slide plate 108 (e.g., protrusions 408, 410 of the slide plate 108). The guide rail 602, hybrid bearing 604, and guide rail support 606 form a guide rail assembly 610 that is attached to the bottom portion 504 of the floorplate 110, for example. The guide rail assembly 610 facilitates movement of the slide plate 108 (and, therefore, the chair head assembly 101) with respect to (e.g., outside and on top of, etc.) the floorplate 110 via the track 112. Thus, the slide plate mount 506 moves along the guide rail 602 using the bearing/slide 604 to move the slide plate 108 (and support member 106 and chair head assembly 101) along the track 112 of the floorplate 110.

As shown in the example of FIG. 6, multiple slide bearings 604 (e.g., two bearings 604 on guide rail 602, etc.) help to movably affix the slide plate mount 506 along the guide rail 602. Thus, the slide plate mount 506 and its attached slide plate 108 can move along the guide rail 602 using the bearings 604 but constrained by the bearings 604 to keep on the guide rail 602. The guide rail support 606, attached to the lower portion 504 of the floorplate 110, provides support to the guide rail 602 to maintain the weight of the chair head assembly 101 on the slide plate 108 attached to the slide plate mount 506. Although only one side of the floorplate assembly 111 is shown in exploded view in the example of FIG. 6, it is understood that a duplicate assembly is provided on the other longitudinal side of the floorplate 110. Thus, both longitudinal sides of the slide plate 108 move in tracks 112 along the floorplate 110 supported by the guide rail assembly 610.

Figure 7:
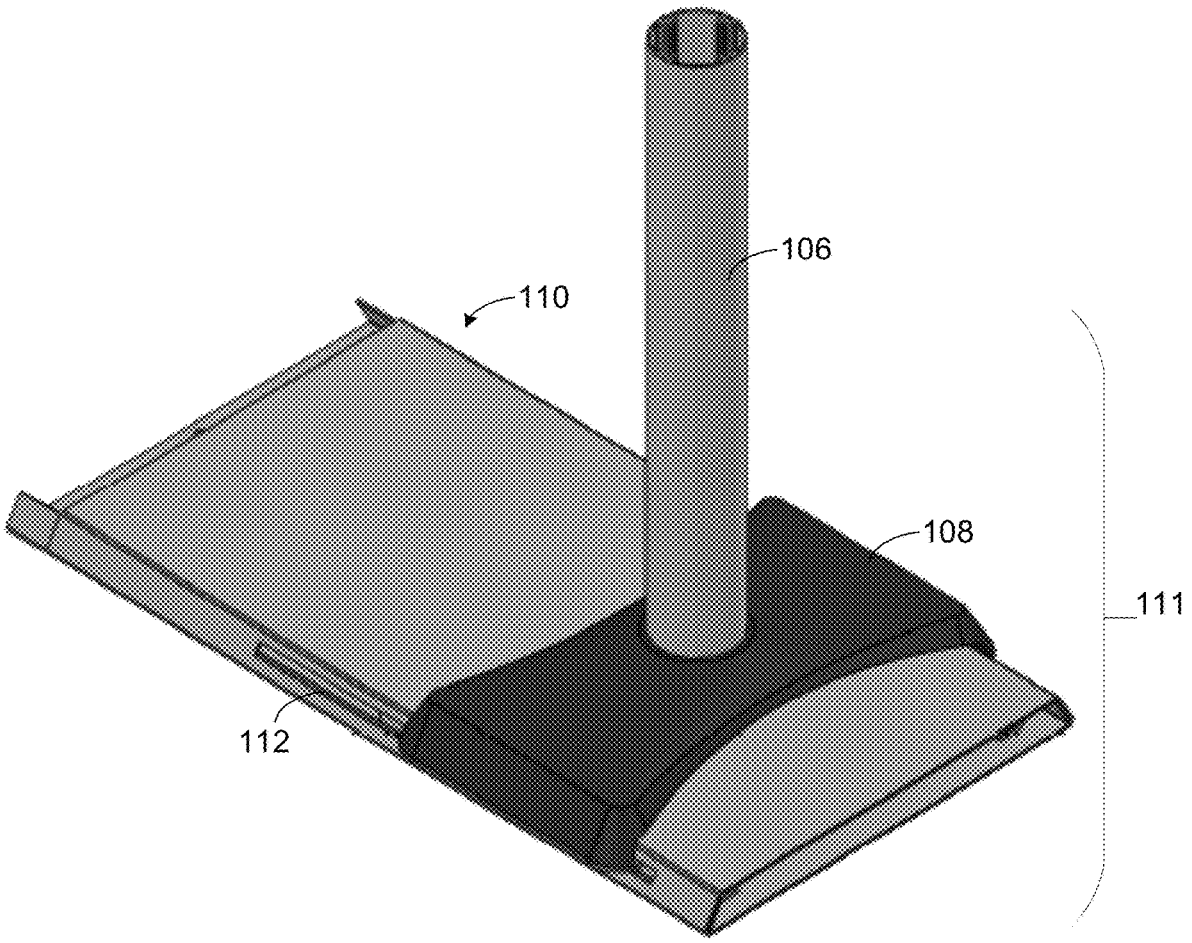
FIG. 7 shows a perspective view of the floorplate assembly of the example of FIG.

FIG. 7 shows a perspective view of the floorplate assembly 111 including the support member 106, slide plate 108, and floorplate 110 apart from the chair head assembly 101. As shown in the example of FIG. 7, the slide plate 108 is a contiguous piece in which the top, sides, and protrusions are formed from a single piece of plastic, metal, and/or other composite material to provide a sturdy, durable, secure, integrated part to move along the floorplate 110. As shown in the example of FIG. 7, the floorplate 110 includes a groove or track 112 in which the protrusions of the slide plate 108 can slide, glide, and/or otherwise move within the constraints of the groove or depression 702. In certain examples, the groove 702 is an opening into the floorplate 110. In other examples, the groove 702 is an indentation or depression into the floorplate 110 that does not expose an interior of the floorplate 110.

Figure 8:
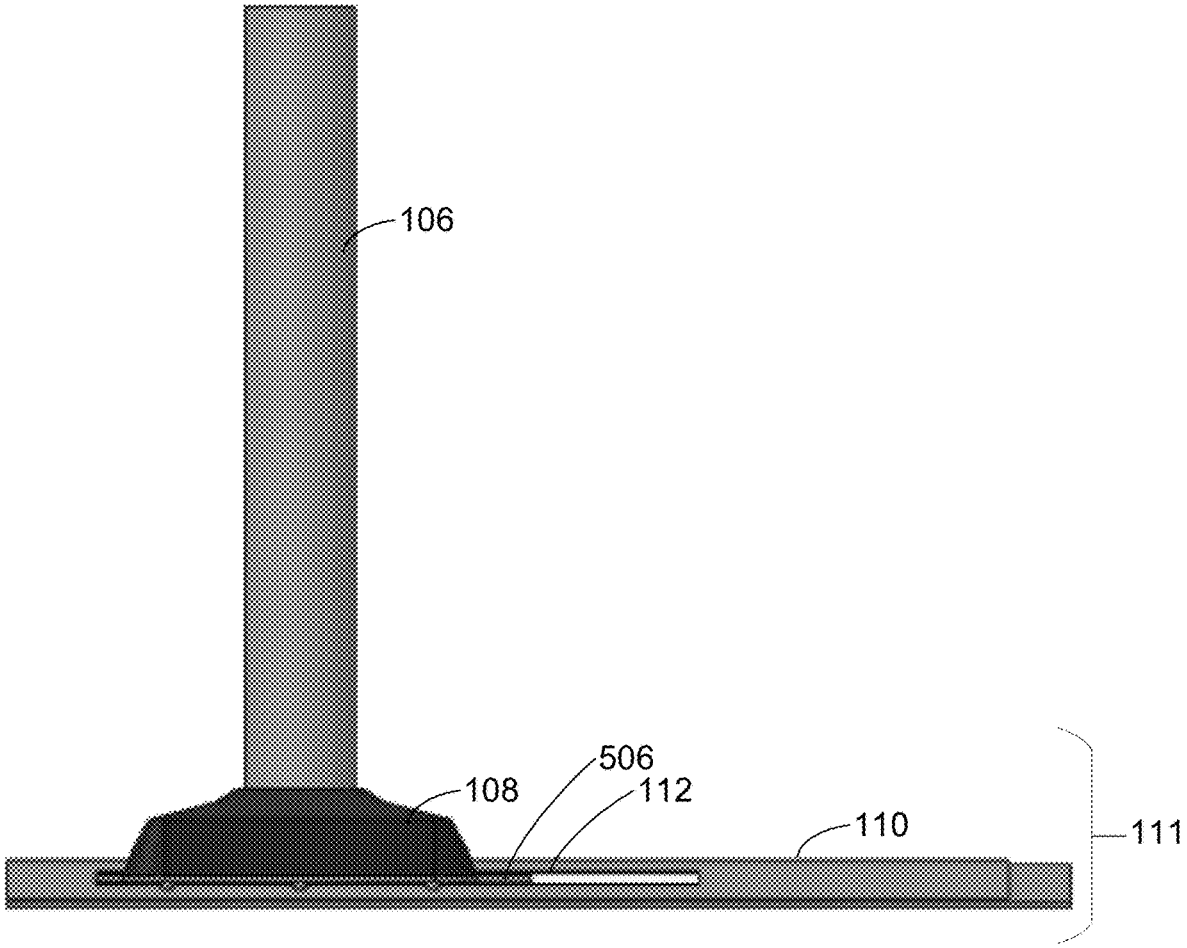
FIG. 8 illustrates a side view of the floorplate assembly of the example of FIG. 1.

FIG. 8 illustrates a side view of the floorplate assembly 111 including the support member 106, slide plate 108, and floorplate 110 as well as the track 112 for movement of the support member slide plate 108. The example side view of FIG. 8 shows the slide plate mount 506 positioned with respect to the slide plate 108 in the track 112 to enable the slide plate 108 (and attached support member 106 and chair assembly 101) to move along the track 112 of the floorplate 110. While some examples do not include the slide plate mount 506, adding the slide plate mount 506 helps to support the slide plate 108 (and support member 106 and chair assembly 101) and constrain movement of the slide plate 108 along the track 112, for example.

Figure 9:
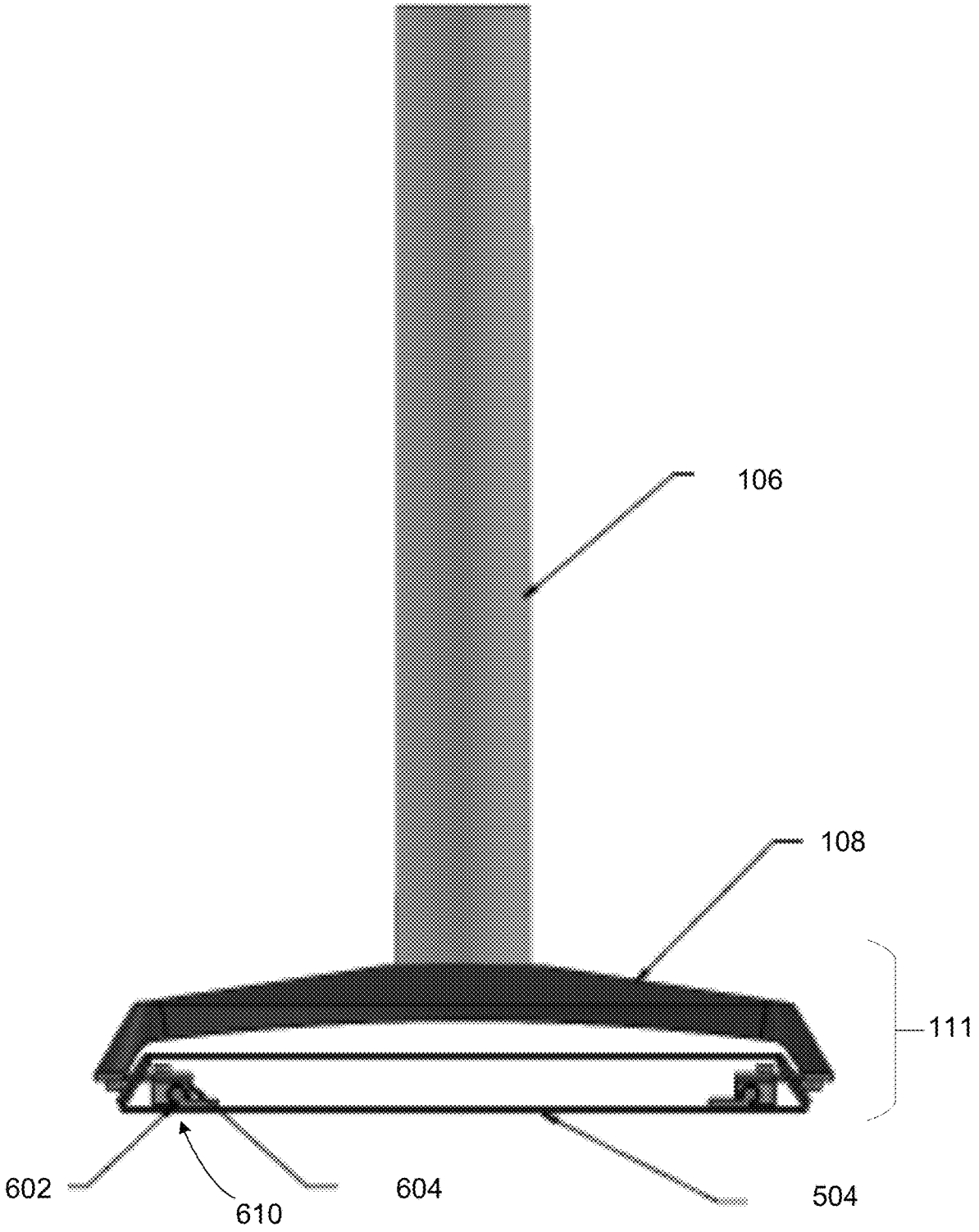
FIG. 9 illustrates a front view of the floorplate assembly of the example of FIG. 1.

FIG. 9 illustrates a front view of the floorplate assembly 111 including the support member 106, slide plate 108, and floorplate 110 as well as the guide rail assembly 610 including the guide rail 602 and the hybrid bearing or slide block 604. As shown in the example of FIG. 9, the slide block/hybrid bearing 604 moves along the guide rail 602 to guide the slide plate 108 along the track 112. As shown in the example of FIG. 9, a guide rail 602 and slide block/bearing 604 are positioned on each longitudinal side of the floorplate 110 with respect to the track 112 on each longitudinal side of the floorplate 110 such that both sides of the slide plate 108 extending along the longitudinal sides of the floorplate 110 are supported and movable with respect to the tracks 112 on the longitudinal sides of the floorplate 110 (e.g., moving towards or away from the viewpoint of FIG. 9).

Thus, certain examples provide a chair 100 including a chair head assembly 101 that is positionable with respect to a floorplate assembly 111 via a movable slide plate 108 attached to a support member 106 affixed to the chair seat portion 102. In certain examples, a locking mechanism can be included with the track 112 in the floorplate assembly 111 to allow the slide plate 108 to be temporarily fixed with respect to the floorplate assembly 111.

Thus, certain examples provide a chair apparatus including a chair head assembly and a floorplate assembly including a slide plate and a floorplate. The example chair head assembly is movably affixed to a slide plate in the floorplate assembly to slide the chair head assembly along at least a portion of the floorplate. The example slide plate is positioned over the floorplate and having a width wider than the floorplate. The example slide plate is to allow the chair head assembly to move along at least a portion of a length of the floorplate.

Certain examples provide a floorplate assembly apparatus including a slide plate and a floorplate. The example slide plate is arranged to receive a support member. The example slide plate is movably affixed to the floorplate via a track along the floorplate. The example slide plate is positioned over the floorplate and has a width wider than the floorplate. The example slide plate is to allow the support member to move along at least a portion of a length of the floorplate assembly.

Certain examples provide a chair apparatus including a chair head assembly means and a floorplate assembly means. The example chair head assembly means is movably affixed to the floorplate assembly means. The example floorplate assembly means is to enable the chair head assembly means to slide along at least a portion of the floorplate assembly means.

While the examples depicted and described herein have been illustrated using a chair with a seat and a back, the floorplate assembly is also applicable to stools and/or other chairs having a seat or base but no back.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

The invention claimed is:

1. A floorplate assembly apparatus comprising:

a slide plate; and a floorplate, the slide plate arranged to receive a support member, the slide plate movably affixed to the floorplate via a track along the floorplate, the slide plate positioned over the floorplate and having a width wider than the floorplate, the slide plate to allow the support member to move along at least a portion of a length of the floorplate assembly, wherein the slide plate includes a main body and two side portions extending substantially perpendicular from the main body alongside the floorplate, each side portion including a protrusion extending into the track along a side of the floorplate, the track allowing the slide plate to move along the track via the protrusions, wherein the floorplate includes an upper plate, a lower plate, and a slide plate mount, the upper plate and the lower plate forming the floorplate with a laterally facing opening to allow the slide plate mount inside the floorplate to be attached to the slide plate to enable the support member attached to the protrusions of the slide plate to move along the opening, wherein the floorplate further includes a guide rail assembly to support the slide plate mount to enable movement of the slide plate, the guide rail assembly including a guide rail, a hybrid bearing, and a guide rail support, and wherein the slide plate mount is arranged to be movable along the guide rail via the hybrid bearing.

2. The floorplate assembly apparatus of claim 1, wherein the support member is attached to a chair including a chair seat portion and a chair back portion.

3. The floorplate assembly apparatus of claim 1, wherein the track includes at least one of an opening or a groove in the floorplate.

* * * * *